US007086188B2

(12) United States Patent
Tsao

(10) Patent No.: US 7,086,188 B2
(45) Date of Patent: Aug. 8, 2006

(54) DUAL MEDIA BILLBOARD

(76) Inventor: Hunter Tsao, 1F, No. 606, Sec. 1, Nei Hu Rd., Taipei (TW)

( * ) Notice: Subject to any disclaimer, the term of this patent is extended or adjusted under 35 U.S.C. 154(b) by 261 days.

(21) Appl. No.: 10/654,024

(22) Filed: Sep. 4, 2003

(65) Prior Publication Data

US 2005/0050779 A1 Mar. 10, 2005

(51) Int. Cl.
*G09F 9/00* (2006.01)

(52) U.S. Cl. ..... 40/505; 40/503

(58) Field of Classification Search ..... 40/503–507, 40/447–452; 160/236, 167.1 V, 10
See application file for complete search history.

(56) References Cited

U.S. PATENT DOCUMENTS 1,806,722 A * 5/1931 von der Lippe ..... 40/505
5,029,413 A * 7/1991 Jovanovic ..... 49/82.1
5,263,529 A * 11/1993 Landis ..... 160/236

FOREIGN PATENT DOCUMENTS

JP 03001183 A * 1/1991

* cited by examiner

*Primary Examiner*—Cassandra Davis
(74) *Attorney, Agent, or Firm*—Dennison, Schultz, Dougherty & MacDonald

(57) ABSTRACT

A revolving billboard with LED holders has an outdoor frame, an LED frame and a vertical louvered blind. The LED frame is mounted inside the upper recess, and the vertical louvered blind is located in front of the LED holders inside the upper recess. The revolving billboard provides a clear image by the LED frame at night and also provides a good image due to the vertical louvered blind during the day.

4 Claims, 8 Drawing Sheets

DUAL MEDIA BILLBOARD

BACKGROUND OF THE INVENTION

1. Field of the Invention

The present invention relates to a billboard, and more particularly to a dual media billboard.

2. Description of Related Art

Outdoors, billboards show many different advertisements and have proven to be an effective manner of catching the attention of consumers for many, many years. The billboards are hung on the wall of a building or built on the top floor of a building. There are many types of billboards, some show a fixed advertisement for a period of time, some show two different advertisements in turns by revolving the billboard, and others show advertisements on a wall formed by LED (light-emitting diode) lamps controlled by electricity and computers.

With reference to FIGS. 9 and 10, a conventional LED billboard (40) is comprised of a frame (41) and multiple LED assemblies (42). The frame (41) consists of multiple cubic frame segments (411) and each frame segment consists of multiple frame sections (412). Each frame section (412) is square and has a top (not numbered), a bottom (not numbered), a front (not numbered), a back (not numbered), a through hole (413) and an access panel (414). The access panel (414) has an inside surface (not numbered) and is mounted on the back of the frame section (412). Each LED assembly (42) comprises an array (421) of LEDs (422) and a control device (423). The control device (423) is mounted on the inside surface of the access panel (414). The LED billboard (40) can show many types of advertisements at a time and can be conveniently controlled by electricity and computers. However, the conventional LED billboard (40) needs a lot of LEDs (422) so the LED billboard (40) can show advertisements clearly during the day. However, not all the LEDs (422) are required at night but remain powered on so a lot of electricity is wasted. Furthermore, when workers repair or work on conventional LED billboard (40), the control device (423) of each LED assembly (42) is accessed through the access panel (414), and the LEDs (422) are accessed from the front of the LED billboard (40). This conventional LED billboard (40) must have a large volume to hold the control device (423) and is not convenient to protect, access and repair.

To overcome the shortcomings, the present invention provides a revolving billboard that has good visibility during the day, saves electricity, uses fewer LEDs and is convenient to access and repair to mitigate or obviate the aforementioned problem.

SUMMARY OF THE INVENTION

The primary objective of the present invention is to provide a dual media billboard. The dual media billboard in accordance with the present invention is clearly visible during the day, is efficient in electricity consumption and uses a minimum quantity of LED lamps to achieve a suitable illuminating effect in both day and night. Furthermore, the dual media billboard also provides a convenient way to protect, access and repair the circuit.

Other objects, advantages and novel features of the invention will become more apparent from the following detailed description when taken in conjunction with the accompanying drawings.

DETAILED DESCRIPTION OF THE PREFERRED EMBODIMENT

Figure 1:
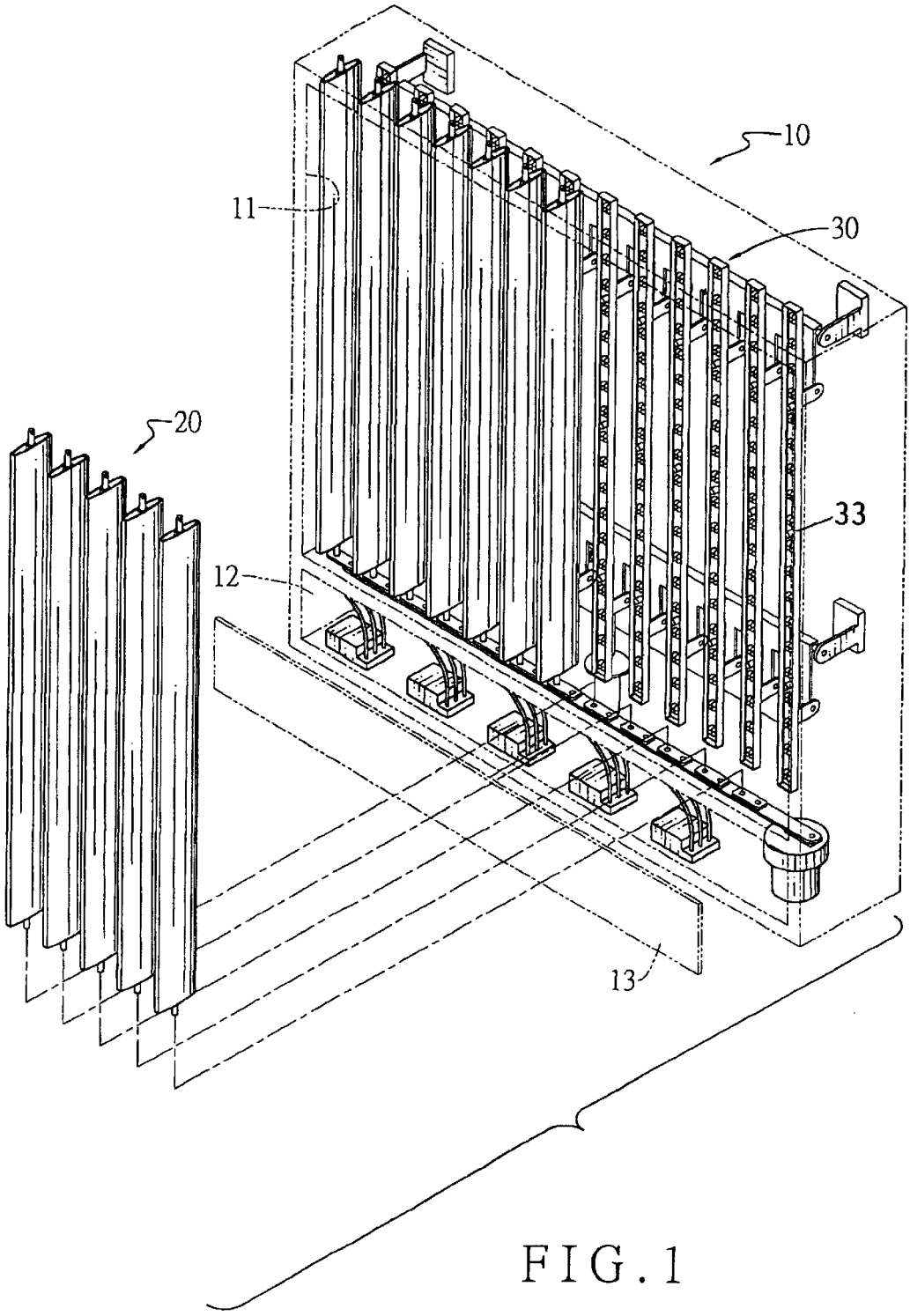
FIG. 1 is a perspective view of the revolving billboard with LED holders in accordance with the present invention.

With reference to FIG. 1, a dual media billboard in accordance with the present invention includes an outdoor frame (10), a vertical louvered blind (20) and an LED frame (30).

The outdoor frame (10) is rectangular and is comprised of an upper recess (11), a partition (not numbered) and a lower recess (12) with an access panel (13) mounted over the lower recess (12). The upper recess (11) has a top (not numbered) and a bottom (not numbered). The lower recess (12) has a top (not numbered) and a bottom (not numbered). The partition is formed at the bottom of the upper recess (11) and the top of the lower recess (12).

Figure 2:
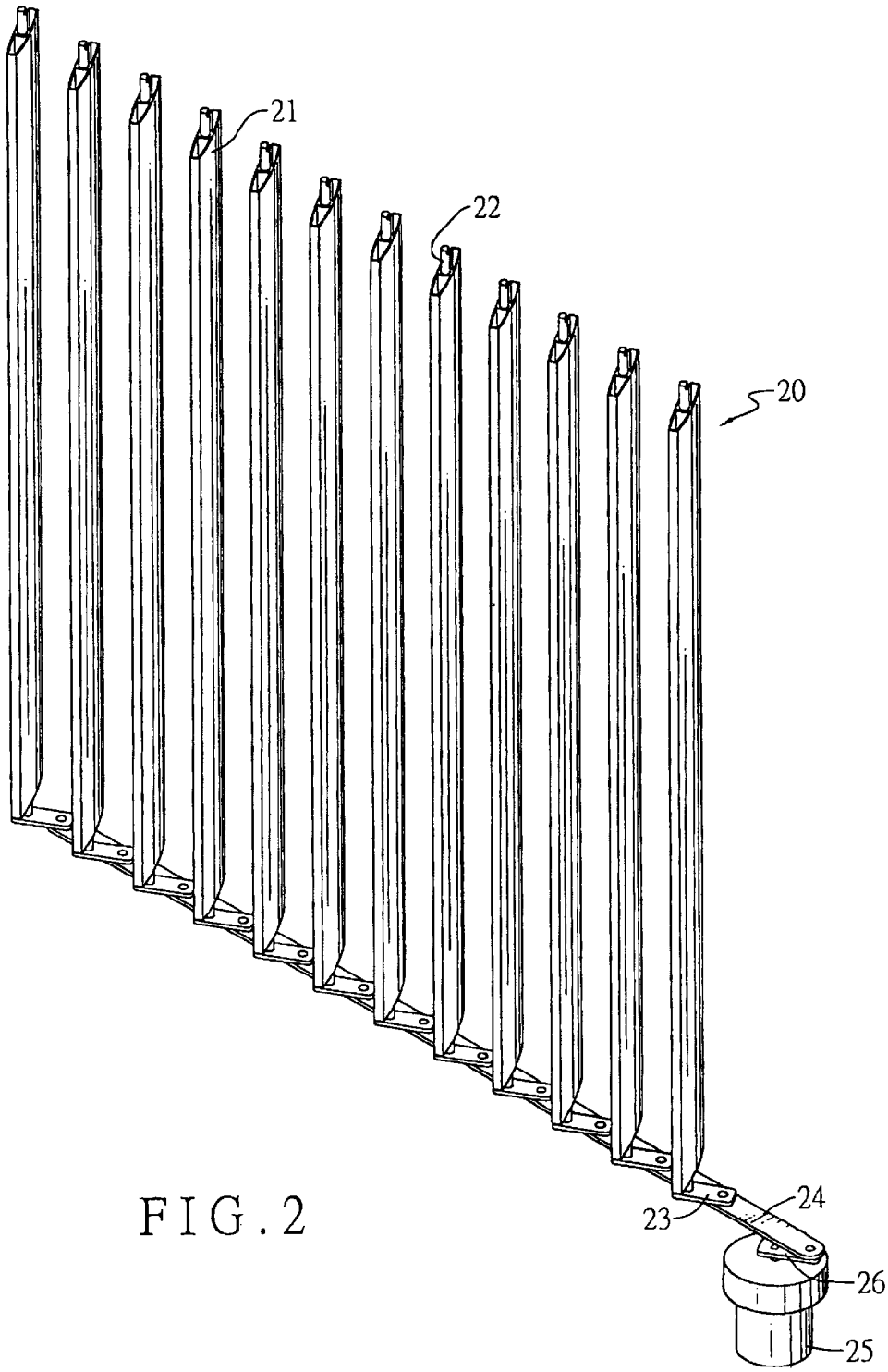
FIG. 2 is a perspective view of the vertical louvered blind of the revolving billboard in FIG. 1.
Figure 3:
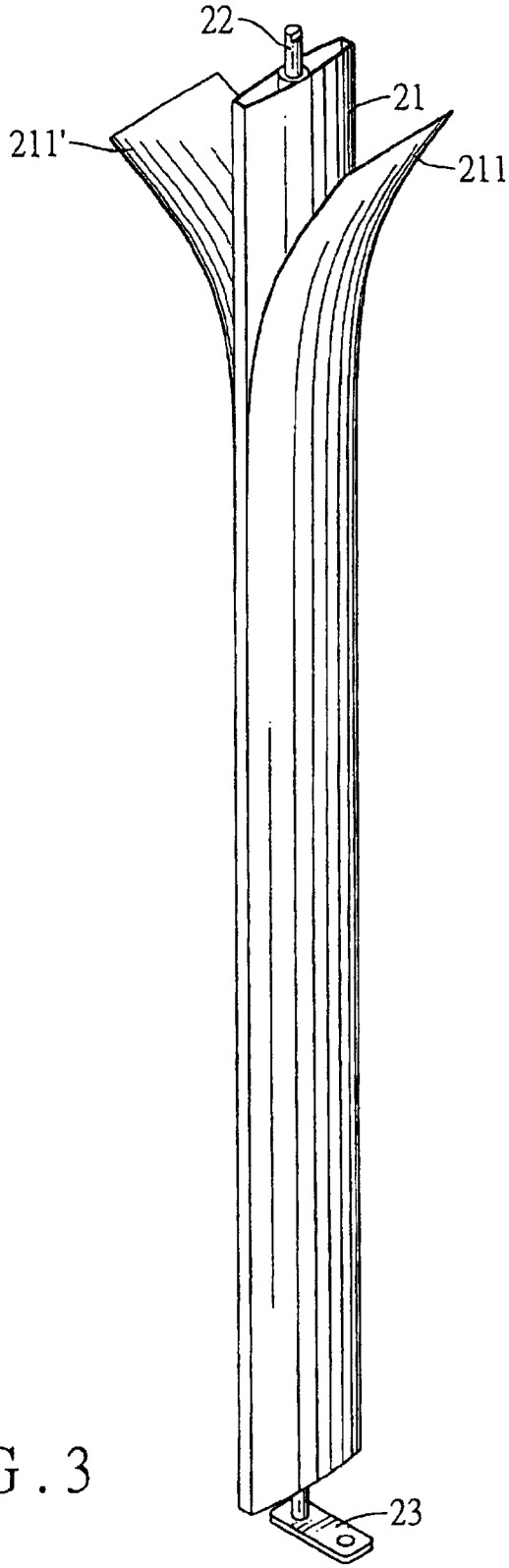
FIG. 3 is a partially exploded perspective view of the vertical louvered blind bar of the revolving billboard in FIG. 2.

With further reference to FIGS. 1 to 3, the vertical louvered blind (20) is mounted inside the upper recess (11) of the outdoor frame (10) and includes multiple rectangular slats (21), rods (22), revolving pieces (23), a drive arm (24), a connecting piece (26) and a motor, such as a reducing motor (25). Each rectangular slat (21) has two side surfaces (not numbered). The rod (22) has a distal end (not numbered) and a proximal end (not numbered). Each revolving piece (23) has a distal end (not numbered) and a proximal end (not numbered). The rod (22) is extended through each rectangular slat (21) and the partition of the outdoor frame (10), and the distal end of the rod (22) is pivotally mounted on the proximal end of the revolving piece (23). The distal end of each revolving piece (23) is pivotally attached to the drive arm (24) and the revolving pieces (23) and the drive arm (24) are mounted inside the lower recess (12) of the outdoor frame (10). The proximal end of each rectangular slat (21) is pivotally mounted inside the top of the top recess (11). The drive arm (24) has a distal end (not numbered) and a proximal end (not numbered). The proximal end of the drive arm (24) is pivotally mounted on the reducing motor (25) by the connecting piece (26). The side surfaces of each rectangular slat (21) can have different coverings (211,211') adhered thereon.

Figure 4:
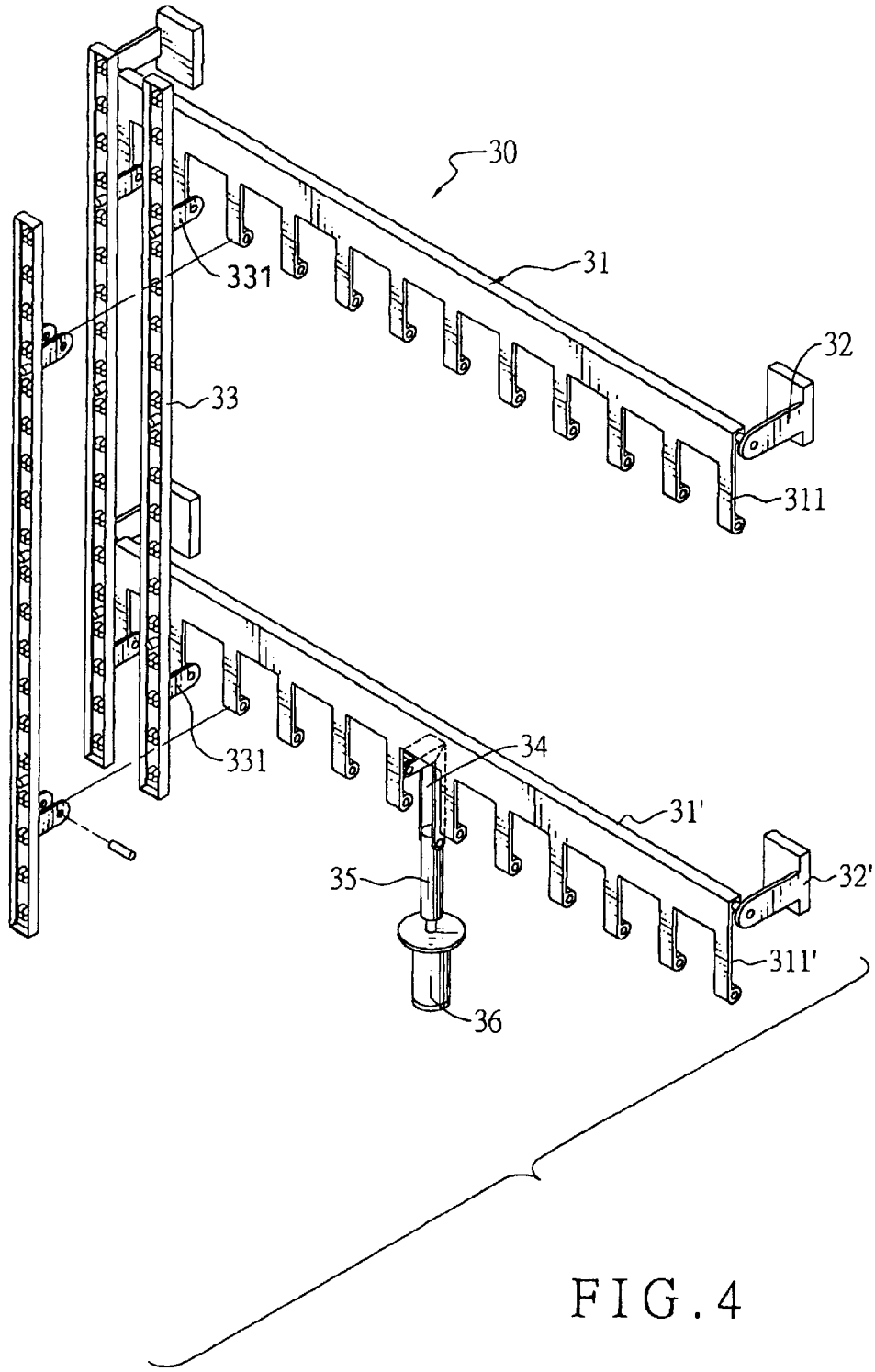
FIG. 4 is a perspective view of the LED frame of the revolving billboard in FIG. 1.
Figure 5:
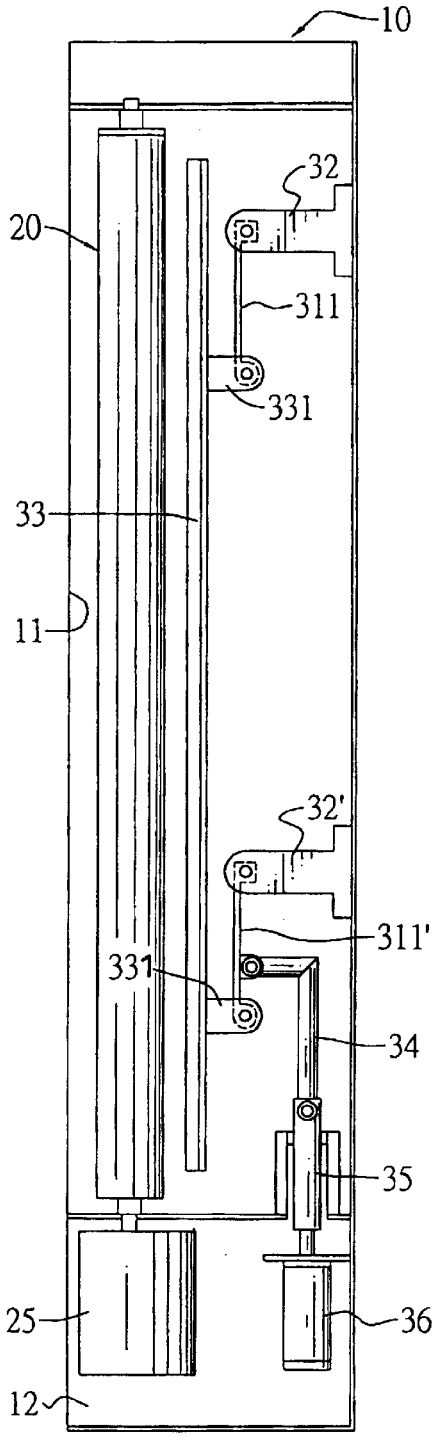
FIG. 5 is an operational side plan view of the revolving billboard in FIG. 1.
Figure 6:
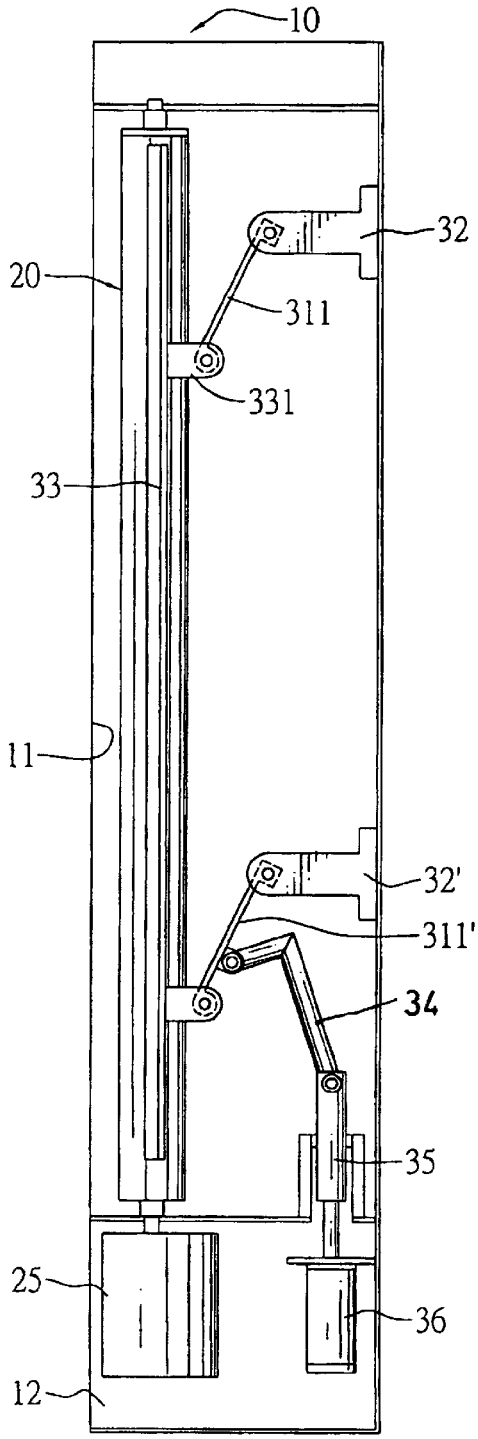
FIG. 6 is an operational side plan view of the revolving billboard in FIG. 1.
Figure 7:
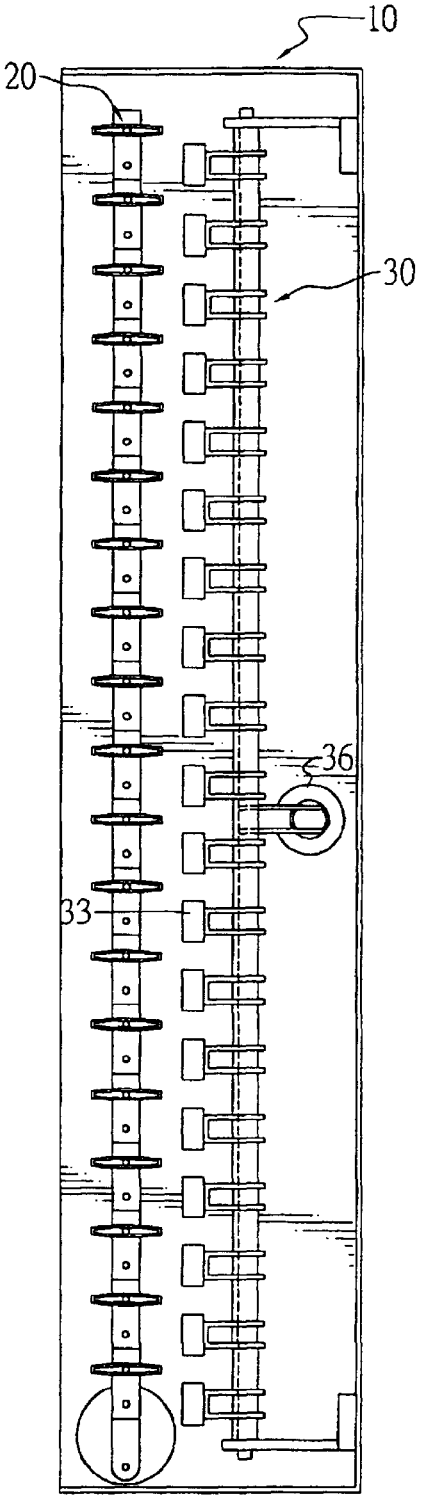
FIG. 7 is an operational top plan view of the revolving billboard in FIG. 1.
Figure 8:
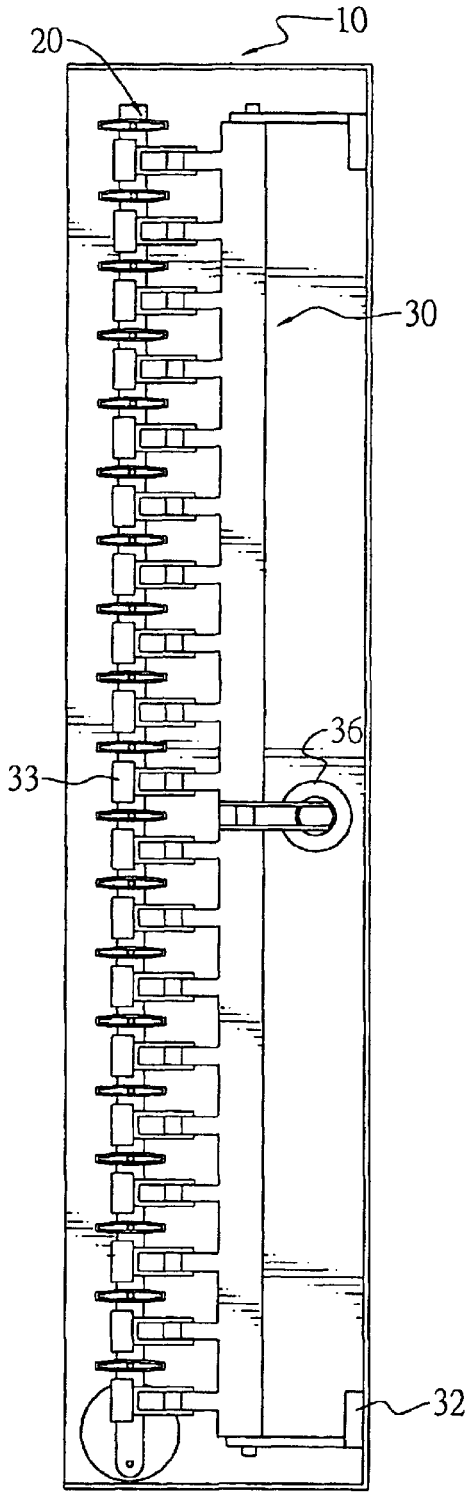
FIG. 8 is an operational top plan view of the revolving billboard in FIG. 1.
Figure 9:
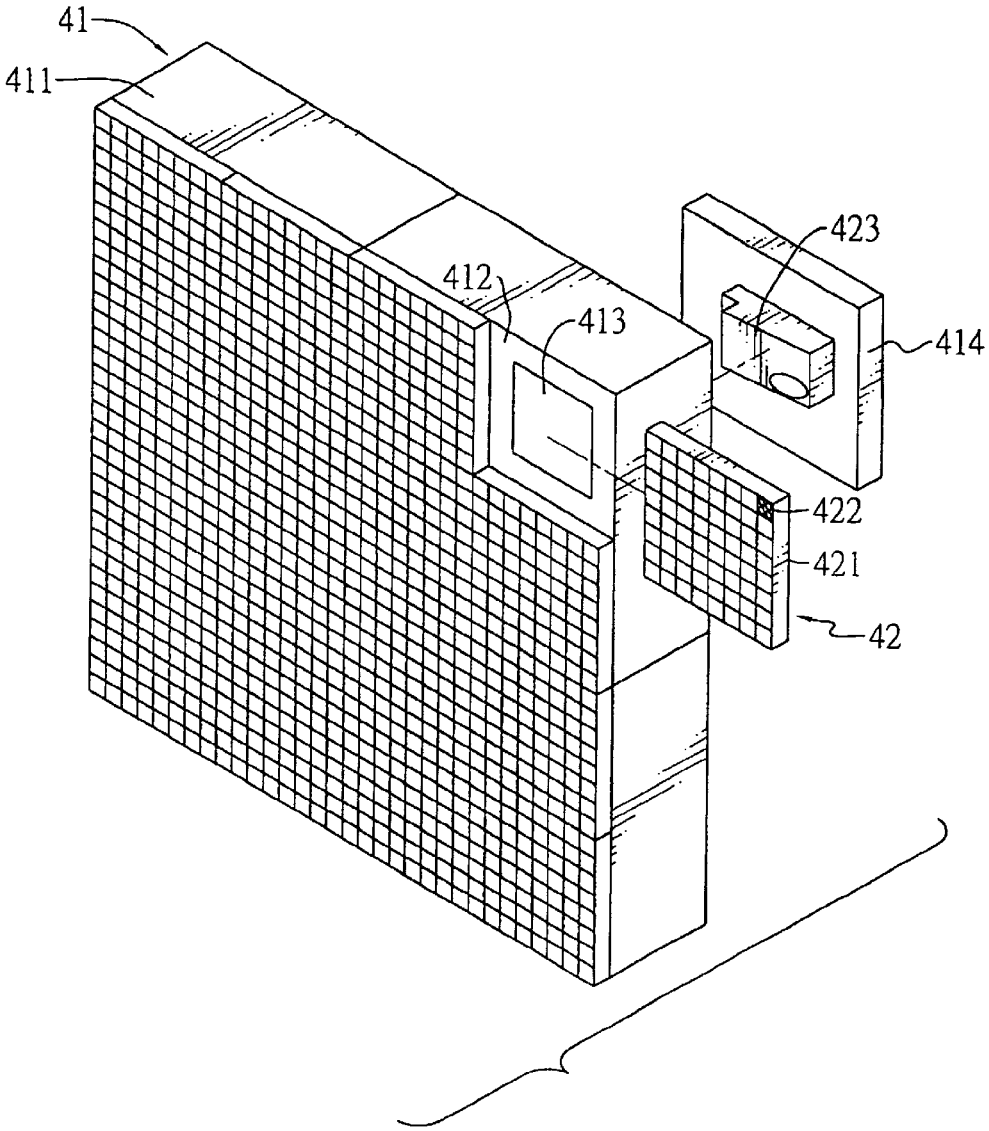
FIG. 9 PRIOR ART
FIG. 9 is a partial perspective view of a conventional billboard with LED lamps in accordance with the prior art.
Figure 10:
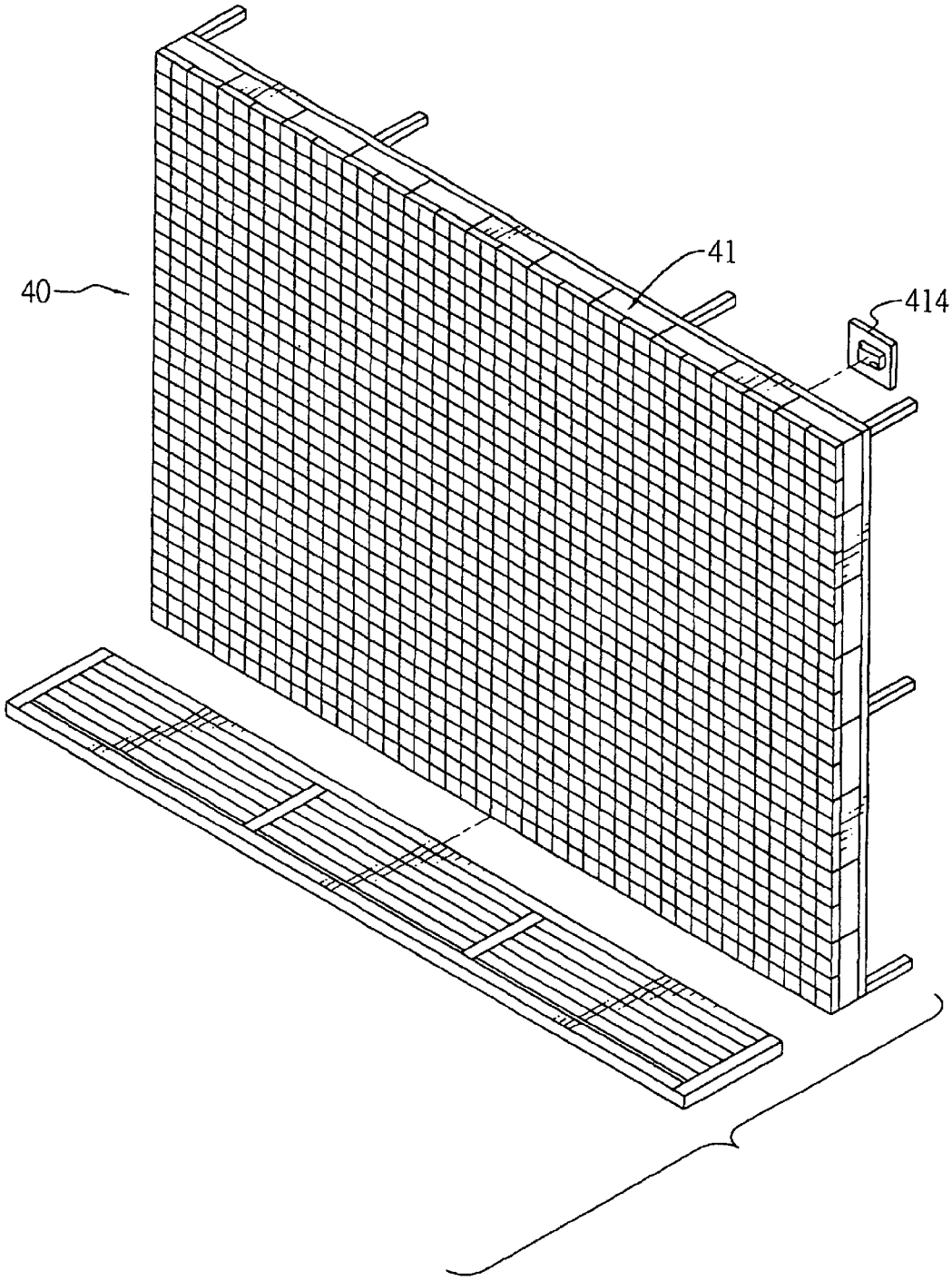
FIG. 10 PRIOR ART
FIG. 10 is a perspective view of the conventional billboard in FIG. 9 with means to attach it to a wall.

With reference to FIG. 4, the LED frame (30) is mounted inside the upper recess (11) of the outdoor frame (10) in the rear of the vertical louvered blind (20), and has an upper bracket (31), a lower bracket (31'), at least one upper bracket holder (32), at least one lower bracket holder (32'), multiple LED holders (33), a push arm (34), a rod (35) and a driving device, such as a cylinder or a pneumatic cylinder (36). The upper bracket (31) and lower bracket (31') are shaped like a comb and each have a bottom surface (not numbered), two ends (not numbered) and multiple extending pieces (311, 311') wherein each extending piece (311,311') has a pivot hole (not numbered). The extending pieces (311,311') are formed from the bottom surface. The upper bracket holders (32) and the lower bracket holders (32') are mounted inside the top recess (11). The bracket holders (32,32') are L-shaped and each bracket holder (32,32') has a transverse arm (not numbered) and a longitudinal arm (not numbered). The bracket holders (32,32') are respectively pivoted with the two ends of the upper bracket (31) and the lower bracket (32').

Each LED holder (33) has a U-shaped holder (not numbered), a circuit board (not numbered), two pivot tabs (331) and multiple LED lamps (not numbered). The U-shaped holder has an outside bottom surface (not numbered), a distal end (not numbered) and a proximal end (not numbered). The circuit board is mounted inside the U-shaped holder and the multiple LED lamps are mounted on the circuit board. The pivot tabs (331) are mounted on the outside bottom surface and respectively at the distal end and the proximal end of the U-shaped holder. Each pivot tab (331) mounted at the distal end and the proximal end of the LED holder (33) faces a respective one of the extending pieces (311 or 311').

The push arm (34) is L-shaped and has a transverse arm (not numbered) and a longitudinal arm (not numbered). The transverse arm of the push arm (34) is pivoted with the one of the extending pieces (311') of the lower bracket (31'). The longitudinal arm of the push arm (34) is longitudinally abutted with the rod (35). The rod (35) is connected to the pneumatic cylinder (36) and mounted through the partition of the outdoor frame (10). The pneumatic cylinder (36) is mounted inside the lower recess (12).

With further reference to FIGS. 1 and 2, the LED holders (33) are connected to circuits that are mounted inside the lower recess (12) of the outdoor frame (10) and the circuits are connected to a power supply (not shown) to light up LED lamps mounted inside the LED holders (33).

When the reducing motor (25) is turned on, the reducing motor (25) will drive the connecting piece (26) to rotate. The drive arm (24) will be driven to move forward and backward by the connecting piece (26) and pull or push each revolving pieces (23) to pivotally rotate relative to the drive arm (24). Consequently, the slats (21) pivotally connected to the revolving pieces (23) will be rotated to a desired angle such as 0° to 90° and than to 180°. With reference to FIGS. 5 to 8, when turning on a power supply (not shown) during the day, the pneumatic cylinder (36) will drive the rod (35) move up and down. The moving rod (35) pushes the push arm (34) to move inclinedly and the push arm (34) pushes the lower bracket (32') and the upper bracket (32). Because the push arm (34) is pivotally connected to the extending piece (311') and the extending piece (311,311') is pivoted with the pivot tab (331), the LED holders (33) are pushed between the rectangular slats (21) of the vertical louvered blind (20).

When using the revolving billboard with LED holders in accordance with the present invention, users can show the advertisements just on the vertical louvered blind (20) by closing the slats (21) in the 0° or 180° position and the advertisements on two coverings (211,211') during the day. During the night, user can open the vertical louvered blind (20) and each slat (21) is in the 90° position to show the advertisements on the LED holders (30).

Accordingly, the revolving billboard with LED holders in the present invention can show advertisements by the vertical louvered blind (20) with minimal electric power to revolve the slats (21) during the day, and with few LED lamps to show advertisements during the night. Furthermore, as the circuit connected to the LED holders (33), the reducing motor (25) and the pneumatic cylinder (36) are mounted inside the lower recess (12) with an access panel (13), when workers repair or work on revolving billboard with LED holder, they can easily repair or fix it via the access panel (13).

Even though numerous characteristics and advantages of the present invention have been set forth in the foregoing description, together with details of the structure and function of the invention, that the disclosure is illustrative only, and changes may be made in detain, especially in matters of shape, size, and arrangement of parts within the principles of the invention to the full extent indicated by the broad general meaning of the terms in which the appended claims are expressed is to be understood.

What is claimed is:

1. A dual media billboard comprising: an outdoor frame having an upper recess, a lower recess, an access panel received in the lower recess;

an LED frame with an upper bracket and a lower bracket received inside the upper recess of the outdoor frame, each one of the upper bracket and the lower bracket having a bottom surface, two ends, and multiple extending pieces formed from the bottom surface of the upper and lower brackets;

multiple bracket holders mounted inside the upper recess of the outdoor frame and each bracket holder having a transverse arm pivotally attached to one of the upper bracket and the lower bracket; and a longitudinal arm integrally extending from the transverse arm and mounted inside the upper recess of the outdoor frame;

multiple LED holders pivotally attached to the extending pieces of the upper bracket and lower bracket and each LED holder having an U-shaped holder with an outside bottom surface, a distal end and a proximal end;

a circuit board mounted inside the U-shaped holder; and two pivot tabs mounted on the outside bottom surface and respectively at the distal end and the proximal end of the U-shaped holder, wherein the LED lamps are mounted on the circuit boards;

a push arm pivotally connected with one of the upper bracket and the lower bracket, being L-shaped and having a transverse arm and a longitudinal arm, a rod abutted with the longitudinal arm of the push arm, and a cylinder connected to the rod and mounted inside the lower recess;

a vertical louvered blind mounted in front of the LED frame and receiving inside the outdoor frame, the vertical louvered blind having a driving device for extending the vertical louvered blind to a closed position whereby the LED frame is concealed by the vertical louvered blind and the vertical louvered blind displays an image, and to an opened position whereby the LED frame is exposed to display an illuminating image.

2. The dual media billboard as claimed in claim 1, wherein the vertical louvered blind mounted inside the upper recess of the outdoor frame and having multiple rectangle slats arranged in a row, each slat having two surfaces multiple rods respectively extending through the slats and each rod having a distal end; and a proximal end pivoted inside the upper recess;

multiple revolving pieces respectively pivotally connected to the distal ends of the rods and each revolving piece having a distal end, and a proximal end pivotally attached to the distal end of a corresponding one of the rods, a drive arm having a proximal end and pivotally attached to the distal ends of the revolving pieces and mounted inside the lower recess of the outdoor frame, and a motor pivotally attached to the proximal -end of the -drive arm and mounted inside the lower recess of the outdoor frame.

3. The dual media billboard as claimed in claim 1, wherein the cylinder is a pneumatic cylinder.

4. The dual media billboard as claimed in claim 2, wherein the motor is a reducing motor.

* * * * *